United States Patent [19]

Scott

[11] 4,402,097

[45] Sep. 6, 1983

[54] EXPANDABLE SUPPORT FRAME FOR FLEXIBLE SLEEPING MATTRESSES

[76] Inventor: Frances M. Scott, 6104 Ricky Allen Rd., Knoxville, Tenn. 37918

[21] Appl. No.: 190,327

[22] Filed: Sep. 24, 1980

[51] Int. Cl.[3] ..... A47C 19/04

[52] U.S. Cl. ..... 5/181; 5/93 B; 5/99 A; 5/185; 5/200 R; 5/201; 5/202

[58] Field of Search ..... 5/200 R, 200 C, 201, 5/99 B, 100, 175, 185, 181, 285, 286, 292, 303, 93 B, 95, 96, 202, 240, 400

[56] References Cited

U.S. PATENT DOCUMENTS

| | | | |
|---|---|---|---|
| 1,009,902 | 11/1911 | Hanson | 108/89 |
| 1,378,518 | 5/1921 | Boardman | 5/100 |
| 1,411,636 | 4/1922 | Litvak | 5/202 |
| 2,885,695 | 5/1959 | Feezel et al. | 5/240 |
| 3,002,199 | 10/1961 | Galloway | 5/100 |
| 3,093,838 | 6/1963 | Beasely | 5/100 |
| 3,141,178 | 7/1964 | Campbell | 5/202 |
| 3,896,513 | 7/1975 | Boucher et al. | 5/100 |
| 4,125,912 | 11/1978 | Courter | 5/201 |
| 4,128,907 | 12/1978 | Gelbert | 5/200 R |

FOREIGN PATENT DOCUMENTS

| | | | |
|---|---|---|---|
| 1554014 | 10/1969 | Fed. Rep. of Germany | 5/400 |
| 2931511 | 3/1980 | Fed. Rep. of Germany | 5/400 |

*Primary Examiner*—William E. Lyddane
*Assistant Examiner*—Michael Trettel
*Attorney, Agent, or Firm*—Pitts, Ruderman & Kesterson

[57] ABSTRACT

An expandable support frame for providing supportive confinement for variously sized flexible mattresses. The frame includes a support member suitable for being positioned on a supporting surface such as the floor. An expandable mattress housing is mounted on the top of the support member and includes interlocking segments which define a supportive base bound by four vertical sides for retaining the mattress. A housing expansion segment combines with the housing segments to expand the effective size of the housing for supporting various size mattresses.

7 Claims, 7 Drawing Figures

EXPANDABLE SUPPORT FRAME FOR FLEXIBLE SLEEPING MATTRESSES

BACKGROUND AND OBJECTS OF THE INVENTION

This invention relates to an expandable support frame which provides support and confinement for variously sized flexible mattresses.

The need for adjustable bed structures to accommodate infants and children during growth has long been recognized. While parents and guardians can purchase various size beds to accommodate a child's size for a particular period, the purchase of a number of beds can be both expensive and wasteful. Certain prior art devices provide expandable housing mechanisms for conventional spring support systems. However, recent developments in bedding material such as polyurethane foam and encapsuleted water or other liquids have provided new low cost and comfortable bedding which does not require spring supported under-carriages for comfort. Moreover, in certain instances such spring support mechanisms actually prevent the use of flexible matresses.

One example of an adjustable bed frame is illustrated in U.S. Pat. No. 4,192,028 which includes end rails having adjustable lengths. The end rails can be collapsed or extended to adjust the bed frame for receiving mattresses of various widths. Another prior art adjustable bedstead is illustrated in U.S. Pat. No. 2,666,931 which includes a linkage system for adjusting the length and width of the independent corner members which receive the corners of a conventional bed spring assembly.

Each of the following patents includes apparatus for expanding the bedstead or the matress itself: U.S. Pat. Nos. 195,850; 1,193,272; 2,247,667; 2,216,991; 2,271,601; 2,548,547; 2,883,683; and 3,157,889.

OBJECTS OF THE INVENTION

It is an object of the present invention to provide an expandable support frame for supporting a flexible mattress. It is another object of the invention to provide an expandable support frame which can be equipped with a confinement member such that the support frame can be used as a child's crib. Yet another object of the invention is to provide an expandable mattress support frame which can be readily adjustable for receiving and confining variously sized flexible mattresses. Still another object of the invention is to provide an expandable mattress support frame which can be assembled into a single solid unit having a continuous base. A further object of the invention is to provide an expandable mattress support which does not require a spring support system. Other objects and advantages of the invention will become apparent upon reading the detailed description together with the drawings.

SUMMARY OF THE INVENTION

In accordance with various features of the invention, an expandable support frame suitable for providing supportive confinement for variously sized flexible mattresses is provided. The frame includes a support member which is positioned on a supporting surface and defines a top which is disposed at a preselected location spaced above the supporting surface. An expandable mattress housing is mounted on the top of the support member and includes at least two interlocking segments, each segment having a horizontal base element and a vertical side element such that the segments form a supportive base bound by four vertical sides for retaining a flexible mattress. A housing expansion segment is adapted for being inserted between the interlocking housing segments to expand the effective size of the housing. The segments of the housing and the expansion segment or segments are joined to form a single housing unit. In one embodiment of the invention a detachable confinement member is affixed to and extends above the uppermost portion of the mattress housing such that the frame can be used as a child's crib. In another embodiment of the invention, the confinement member is provided with a fastenable folding portion which provides easy access to the crib area for the child's attendant.

DESCRIPTION OF THE PREFERRED EMBODIMENT

Figure 1:
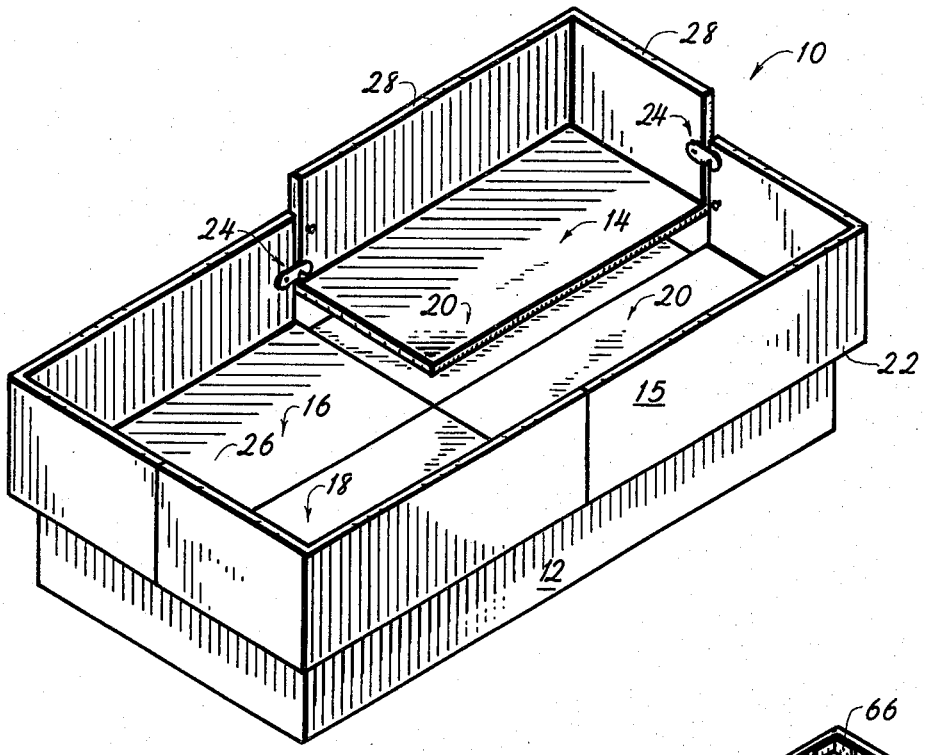
FIG. 1 is an isometric view of the support frame and mattress housing illustrating various features of the invention.

Referring now to the drawings, an expandable support frame suitable for providing supportive confinement for variously sized flexible mattress is generally indicated at 10 in FIG. 1. The frame includes a support member 12 which is substantially rectangular in outline and suitable for being positioned on a supporting surface such as the floor in a child's bedroom. The illustrated support member defines a top 22 which is substantially planer and is positioned at a preselected location above the supporting surface.

An expandable mattress housing 15 is mounted on the top 22 of the support member. This mattress housing 15 is proportioned for receiving a flexible mattress within its confines and can be expanded for purposes of receiving a larger mattress as a child grows and requires larger bedding. More specifically, the expandable housing includes at least two interlocking segments and in the illustrated embodiment segments 14, 16, 18 and 20 are provided which are detachably connected by joining members such as the latches 24 illustrated in FIGS. 1, 3–5. Each of the segments includes a horizontal base element 26 which is substantially planar and forms a supportive base for the mattress. This base is supported on its underside by the top of the support member and engages the mattress on its upperside.

Figure 4:
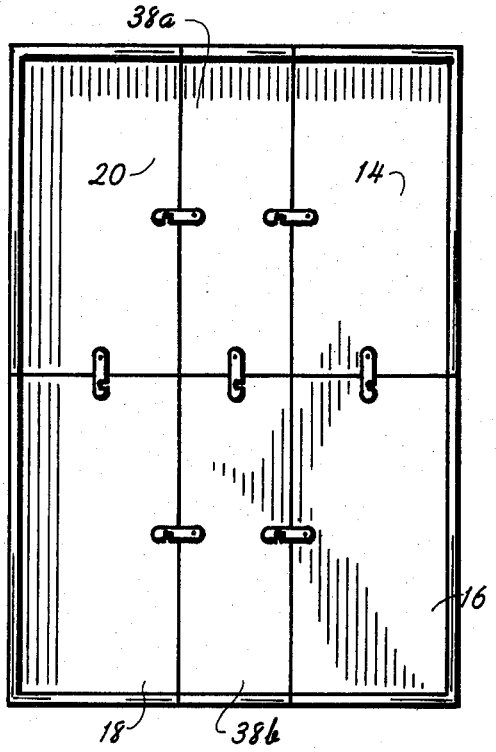
FIG. 4 is a bottom view of the mattress housing with an expansion member inserted to increase the effective width of the housing.

Vertical side elements 28 are secured along at least a portion of the perimeter of the base elements as shown in FIG. 4. These vertical elements or sides assist in preventing a mattress contained within the confines of the housing from moving beyond the housing perimeter. When each of the segments are connected as with the joining members or means 24, a continuous supportive base which is bound by the four vertical sides retains a flexible mattress (not shown) received therein.

Figure 6:
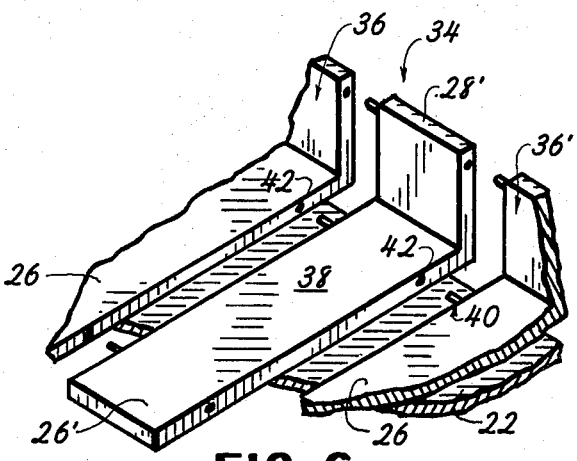
FIG. 6 is perspective view partially in section illustrating the joining members and alignment means used in combining the expansion segment with the expandable mattress housing.

Means are provided for expanding the segmented housing such that larger mattresses can be carried by the housing to accommodate a growing child. In the embodiment indicated generally at 34 in FIG. 6, typical segments 36 and 36' of the housing are illustrated. These segments are separated for illustrative purposes and an insertable expansion segment 38 is positioned between the regular housing sections. This segment 38 includes a base element 26' and a side element 28' which combine with the base elements and side elements of the regular housing segments to form a supportive base and vertical sides for retaining a flexible mattress.

Alignment of the segments is maintained by alignment means generally indicated at 40. More specifically, the alignment means includes a dowel or peg carried by one segment which is received in a corresponding recess 42 in the juxtaposed and mating segment. The assembly is completed by anchoring the joining means or latching members which are hinged about their locking bolts after the peg is inserted into its respective recess. In this connection, the expansion segment and the regular housing segments can be joined as a singular unit for supporting and confining a mattress.

Figure 5:
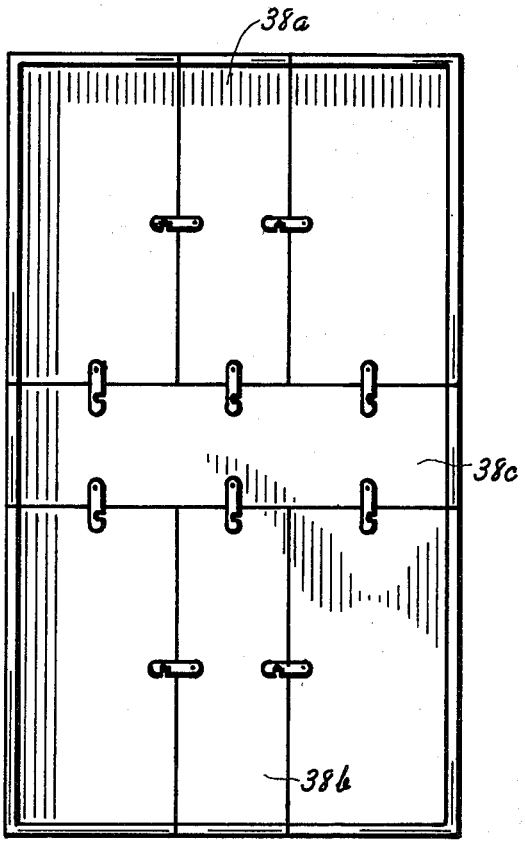
FIG. 5 is a bottom view of the mattress housing with a single lateral and a pair of longitudinal expansion segments inserted to increase the effective width and length of the housing.
Figure 7A:
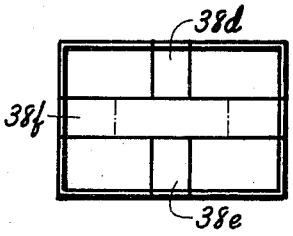
FIGS. 7A and 7B illustrate plan views of the mattress housing with alternate expansion member arrangements.
Figure 7B:
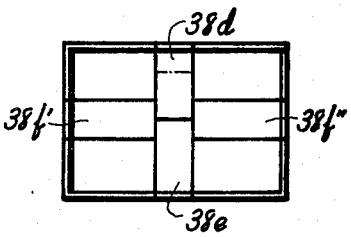

Various arrangements of the housing and expansion segments are provided for lateral and/or longitudinal expansion. FIGS. 4, 5, 7A and 7B illustrate examples of various expansion arrangements. In the embodiment illustrated in FIG. 3, the regular housing segments 14, 16, 18 and 20 are joined by the joining means or latching devices on the under side of the base elements to define the smallest sized mattress housing. In the embodiment depicted in FIG. 4, a longitudinally positioned expansion segments is added to expand the width of the housing. A further embodiment expanded in both the longitudinal and lateral directions is depicted in FIG. 5. The housing segments 14, 16, 18 and 20 are separated by the expansion segments 38A, 38B, and 38C. More specifically, the expansion segments 38A and 38B expand the width of the housing and the expansion segment 38C expands the length of the housing. Further alternate embodiments of the expansion arrangements are depicted in FIGS. 7A and 7B wherein the housing segments 14, 16, 18 and 20 are separated by expansion member 38D, 38E, 38F, 38F' and 38F''. It will become apparent to those skilled in the art that a multitude of various arrangements can be accomplished by altering the size and placement location of the expansion segments. Examples of certain alternate sized expansion segments are illustrated with phantom lines in FIGS. 7A and 7B.

As illustrated in FIG. 4, a pair of mating expansion segments 38A and 38B are joined at their respective edges with adjacent segments and abut at their respective end portions to increase the width dimension of the support. In FIG. 5, the expansion segment 38C has an effective length equal to the width of the regular housing segments combined with the inserted expansion segments 38A and 38B. Similarly, in FIG. 7A the expansion segment 38F which increases the effective width of the housing has a length which is equal to the combined length of the regular housing segments and the expansion segements 38D and 38E. The phantom lines in FIG. 7A illustrate that it is not necessary for the expansion segment 38F to be of continuous length but it could include a plurality of smaller length sections. In FIG. 7B the expansion segments 38D and 38E serve to increase the effective length of the support housing while the expansion segments 38F' and 38F'' serve to increase the effective width of the housing.

Figure 2:
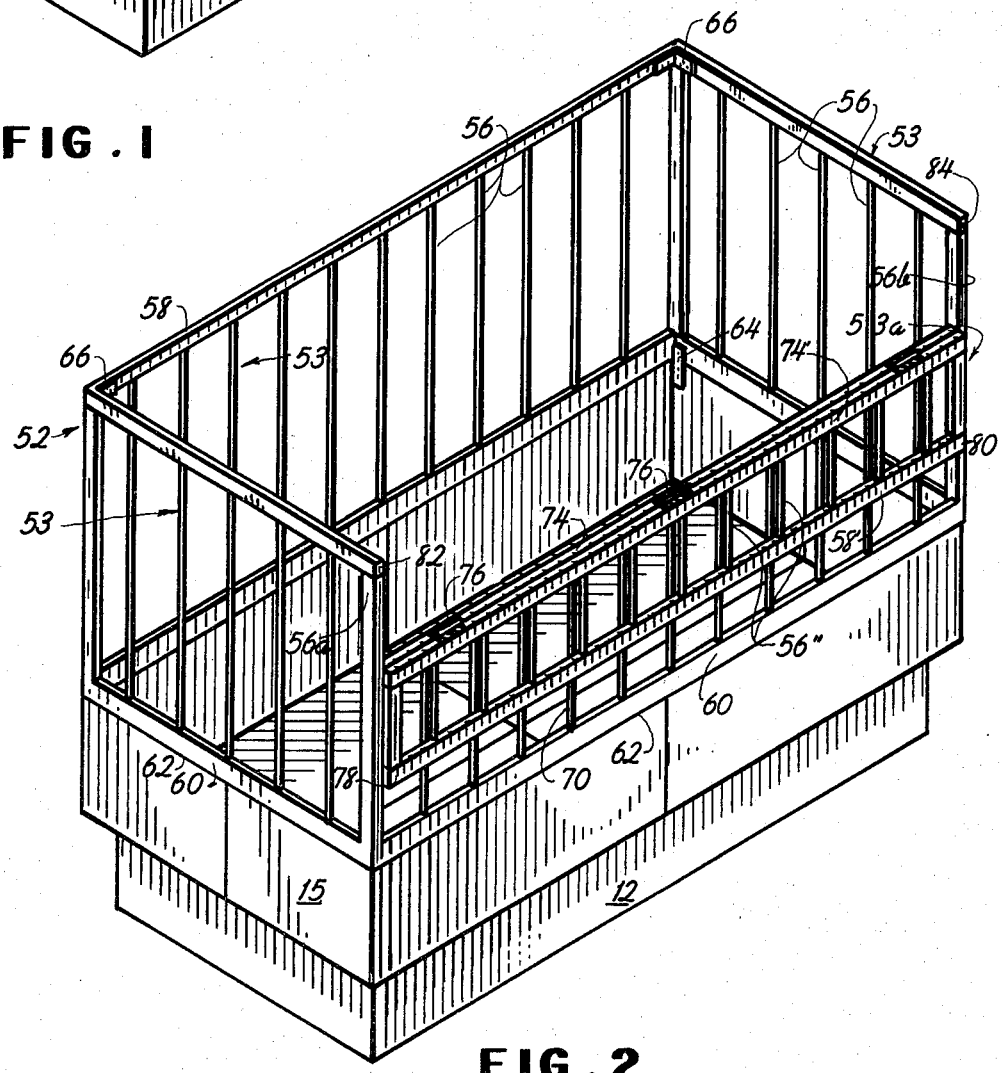
FIG. 2 is an isometric view of the mattress housing with a detachable confinement member mounted thereon such that the housing can be used as a child's crib.
Figure 3:
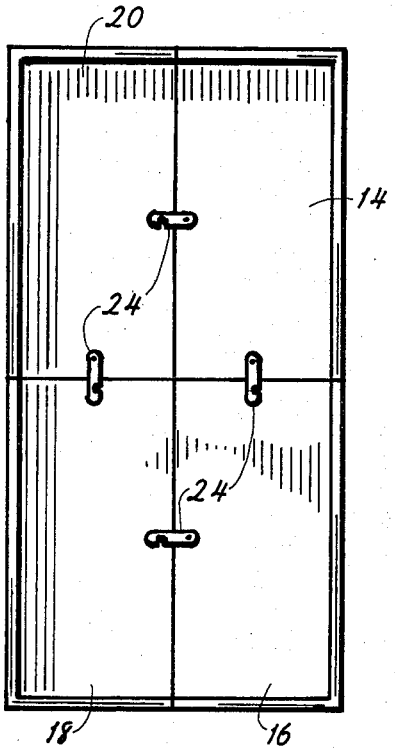
FIG. 3 is a bottom view of the mattress housing.

In applications of the device as a child's crib, a detachable confinement member generally indicated at 52 in FIG. 2 is provided. The confinement member 52 defines a continuous enclosure having vertical sides 53 and is substantially rectangular in outline. Each of the vertical sides contains a multiplicity of vertical bar elements 56 which are spaced at a location to prevent a child from passing therethrough. The vertical elements of each side 53 are joined at their lower ends with a base rail 60 and extend to a horizontal grab rail 58 which is disposed substantially parallel to the base rail.

The base rail 60 of each of the sides is located along the upper edge 62 of the expandable housing, or more specifically the side elements of the housing, and is detachably connected thereto by means of mounting plates 64 positioned at preselected locations and preferably proximate the corners of the housing. The confinement member includes structural bracings 66 located at the corners between mating sides of the confinement member. More specifically, the illustrative bracings are L-shaped and join juxtaposed corners of the upper railing 58.

Means are provided to enhance access to the crib area to facilitate diaper changing and similar operations. In this connection, the crib 52 illustrated in FIG. 2 includes one side 53A of the confinement member 52 which has a fixed section 70 and a section 72 which is pivotally mounted on the fixed section. This fixed section includes a multiplicity of vertical bar elements 56' secured in their upright position between a horizontal base rail 60 and a mounting rail 74 which is attached to the vertical side terminating bar elements 56A and 56B of the adjacent side.

The pivotal section 72 includes a multiplicity of vertical bar elements 56'' secured between the horizontal grab rail 58' and a hinged rail 74'. The hinged rail 74' of the pivotal section 72 is attached to the hinge rail 74 of the fixed section 70 by means of hinges 76. The pivotal section is closed by rotating the grab rail 58' upward until convenient fastening mechanisms located at 78 and 80 on rail 58' lockingly engage grab rails 58 at the location indicated at 82 and 84, respectively. To this end, the folding section can be opened or pivoted to the position indicated in FIG. 2 while the fixed section 70 of the confinement members remains to provide continuing security.

From the foregoing detailed description it will be recognized by those skilled in the art that a support frame for flexible sleeping mattresses has been described and illustrated which has various advantages over known prior art devices. More specifically, the illustrated support frame can be expanded to accommodate and confine larger mattresses during the growth periods of a child. In this connection, both the length and width dimensions of the support housing can be increased simply and efficiently. The device also includes a confinement member which adapts the device for use as a child's crib. One side of the confinement member can be folded to make the confines of the crib area readily accessable by the child's attendant.

Although the invention has been described in terms of illustrated embodiment, many variations and modifications therein will be apparent to those skilled in the art. Accordingly, this invention is intended to cover all such variations and modifications which fall within the spirit and scope of the appended claims.

I claim:

1. An expandable support frame suitable for providing supportive confinement for variously sized flexible mattresses, said frame comprising:

a support member suitable for positioning on a supporting surface and defining a top disposed at a preselected location spaced from said supporting surface;

an expandable mattress housing mounted on said top of said support member said housing including interlocking housing segments, each housing segment including a horizontal base element and vertical side element such that said housing segments form a supportive base bounded by four vertical sides for retaining a flexible mattress;

at least one removable housing expansion segment of a size substantially less than each of said housing segments which expansion segment includes a horizontal base element and a vertical side element, said expansion segment combining with said interlocking housing segments to expand at least one of the length and width dimensions of said housing and thus the effective size of said housing; and a plurality of detachable joining members for releasably interlocking said housing segments and said expansion segment thereby providing means for fixedly assembling said housing segments and expansion segment into a single unit having a continuous horizontal surface and vertical sides.

2. The expandable support frame as described in claim 1 which includes a detachable confinement member defining a continuous enclosure of vertical sides constructed from a multiplicity of vertical bar elements fixedly attached to and located between horizontal rail elements, said confinement member being releasably affixed to and extending above said vertical sides of said mattress housing.

3. The expandable support frame described in claim 2 wherein one of said vertical sides of said detachable confinement member includes a fixed section and a pivotal section, said pivotal section being pivotally carried along an upper portion of said fixed section whereby said pivotal section can be folded against said fixed section for ready access within the confines of said confinement member.

4. The expandable support frame as described in claim 1 wherein said joining members are mounted on the underside of said base elements and on the inside of said vertical side elements of said interlocking housing segments.

5. The expandable support frame of claim 1 including alignment means for fixedly aligning said housing segments and said expansion segment.

6. The expandable support frame as described in claim 1 including a pair of mating expansion segments suitable for being inserted between said interlocking housing segment for increasing the width dimension of said housing.

7. The expandable support frame as described in claims 1, 5 or 6 including an expansion segment for being inserted between said interlocking housing segments for increasing the length dimension of said housing.

* * * * *